US008302967B2

(12) United States Patent
Kim et al.

(10) Patent No.: US 8,302,967 B2
(45) Date of Patent: Nov. 6, 2012

(54) PUZZLE ASSEMBLY WITH ADJUSTABLE THE DEGREE OF DIFFICULTY

(76) Inventors: Jee soo Kim, Paju-si (KR); Jong man Kim, Paju-si (KR)

( * ) Notice: Subject to any disclaimer, the term of this patent is extended or adjusted under 35 U.S.C. 154(b) by 186 days.

(21) Appl. No.: 12/525,307

(22) PCT Filed: Jan. 29, 2008

(86) PCT No.: PCT/KR2008/000539

§ 371 (c)(1),
(2), (4) Date: Mar. 22, 2010

(87) PCT Pub. No.: WO2008/100024

PCT Pub. Date: Aug. 21, 2008

(65) Prior Publication Data

US 2010/0213669 A1 Aug. 26, 2010

(30) Foreign Application Priority Data

Feb. 16, 2007 (KR) ..... 20-2007-0002830 U

(51) Int. Cl.
*A63F 9/08* (2006.01)

(52) U.S. Cl. ..... 273/153 S

(58) Field of Classification Search ..... 273/153 S, 273/153 R, 156, 155
See application file for complete search history.

(56) References Cited

U.S. PATENT DOCUMENTS

| | | | | | |
|---|---|---|---|---|---|
| 4,373,729 | A * | 2/1983 | Hanson et al. | ..... | 273/153 S |
| 4,949,969 | A * | 8/1990 | Johnson | ..... | 273/153 S |
| 5,074,561 | A * | 12/1991 | Johnson | ..... | 273/153 S |
| 5,083,788 | A * | 1/1992 | Conotter | ..... | 273/153 S |
| 5,116,053 | A * | 5/1992 | Blankenburg et al. | ..... | 273/153 S |
| 5,788,232 | A * | 8/1998 | Binkley | ..... | 273/155 |
| 5,957,453 | A * | 9/1999 | Binkley | ..... | 273/153 S |
| 7,275,744 | B1 * | 10/2007 | Kuo | ..... | 273/153 S |
| 2003/0155709 | A1 * | 8/2003 | Han | ..... | 273/153 S |
| 2003/0227131 | A1 * | 12/2003 | Han | ..... | 273/153 S |
| 2006/0061033 | A1 * | 3/2006 | Han | ..... | 273/153 S |

FOREIGN PATENT DOCUMENTS

| | | |
|---|---|---|
| GB | 2107997 | 5/1983 |
| JP | 3128674 | 1/2007 |
| KR | 2019820001430 | 7/1982 |

* cited by examiner

*Primary Examiner* — Steven Wong
(74) *Attorney, Agent, or Firm* — Christopher Paul Mitchell

(57) ABSTRACT

A puzzle assembly which can be adjust the degree of difficulty is disclosed. The disclosed puzzle assembly comprises a rotation shaft, a plurality of rotation plate members having slide grooves on the outer circumference and inserted into the rotation shaft, a plurality of puzzle pieces engaged with the slide grooves movably, wherein at least two of the rotation plate members are coupled together and rotate simultaneously.

6 Claims, 4 Drawing Sheets

PUZZLE ASSEMBLY WITH ADJUSTABLE THE DEGREE OF DIFFICULTY

TECHNICAL FIELD

This invention relates generally to puzzle assembly, which can be adjustable the degree of difficulty.

BACKGROUND ART

Korean publication number 93-25113 discloses cylindrical puzzle assembly with a plurality of holes formed on the outer circumference of cylindrical bodies at regular interval. Puzzle pieces with different colors are inserted into the plurality of holes. A ball and a spring are inserted into a groove formed on one side of each of the cylindrical bodies for stopping the cylindrical bodies. A recess is formed into which the ball contacts on the other side of each of the cylindrical bodies. The several cylindrical bodies with puzzle pieces are inserted in a row into a shaft a side of which an end plate is formed. Other end plate is inserted into the other side of the shaft and finally screwed up into the puzzle assembly.

This conventional puzzle assembly has been useful for a development of children. However, especially an adult has not used the conventional puzzle assembly because this is very easy to putting the puzzle together. The conventional puzzle assembly could not bring a curiosity from an adult and it was boring, especially, by an adult.

DISCLOSURE OF INVENTION TECHNICAL PROBLEM

It is an object of the invention to overcome some of the problems and shortcomings of the prior art. Another object of the invention is to provide an improved puzzle assembly not being boring and being adjustable a degree of difficulty for putting the puzzle together by a user.

TECHNICAL SOLUTION

According to an object of the invention, there is provided a puzzle assembly comprising a rotation shaft; a plurality of rotation plate members having slide grooves on the outer circumference thereof and inserted into the rotation shaft; a plurality of puzzle pieces engaged with the slide grooves movably; wherein at least two of the rotation plate members are coupled together and rotate simultaneously. Therefore, a user can adjust the degree of difficulty.

Here, the rotation shaft may comprise a rotation shaft body, and a nut connected to the rotation shaft body detachably, so as to increase or decrease the number of the rotation plate members.

The rotation shaft may further comprise a plurality of key members; and a plurality of openings into which the key members are inserted formed on the rotation shaft body, each of the rotation plate members may comprise a penetration hole into which the rotation shaft body and the key member can be inserted.

Each of the rotation plate members may further comprise a circular protrusion, and a circular hole into which the circular protrusion can be inserted, so that the rotation plate members can connect or disconnect each other, the puzzle assembly may further comprise a plurality of connecting recesses formed on the inner circumference of the circular hole, and a plurality of connecting protrusions formed on the outer circumference of the circular protrusion and inserted into the connecting recesses.

According to an exemplary embodiment of the present invention, the rotation plate members comprises a first to a fourth rotation plate member, the first and the third rotation plate member are coupled together and rotate simultaneously.

According to another exemplary embodiment of the present invention, the rotation plate members comprises a first to a fourth rotation plate member, the first and the third rotation plate member are coupled together and rotate simultaneously.

ADVANTAGEOUS EFFECTS

According to the puzzle assembly of the present invention, a user can change the degree of difficulty of putting the puzzle at his disposition, by coupling and rotating at least two of the rotation plate members together.

BEST MODE FOR CARRYING OUT THE INVENTION

Figure 1:
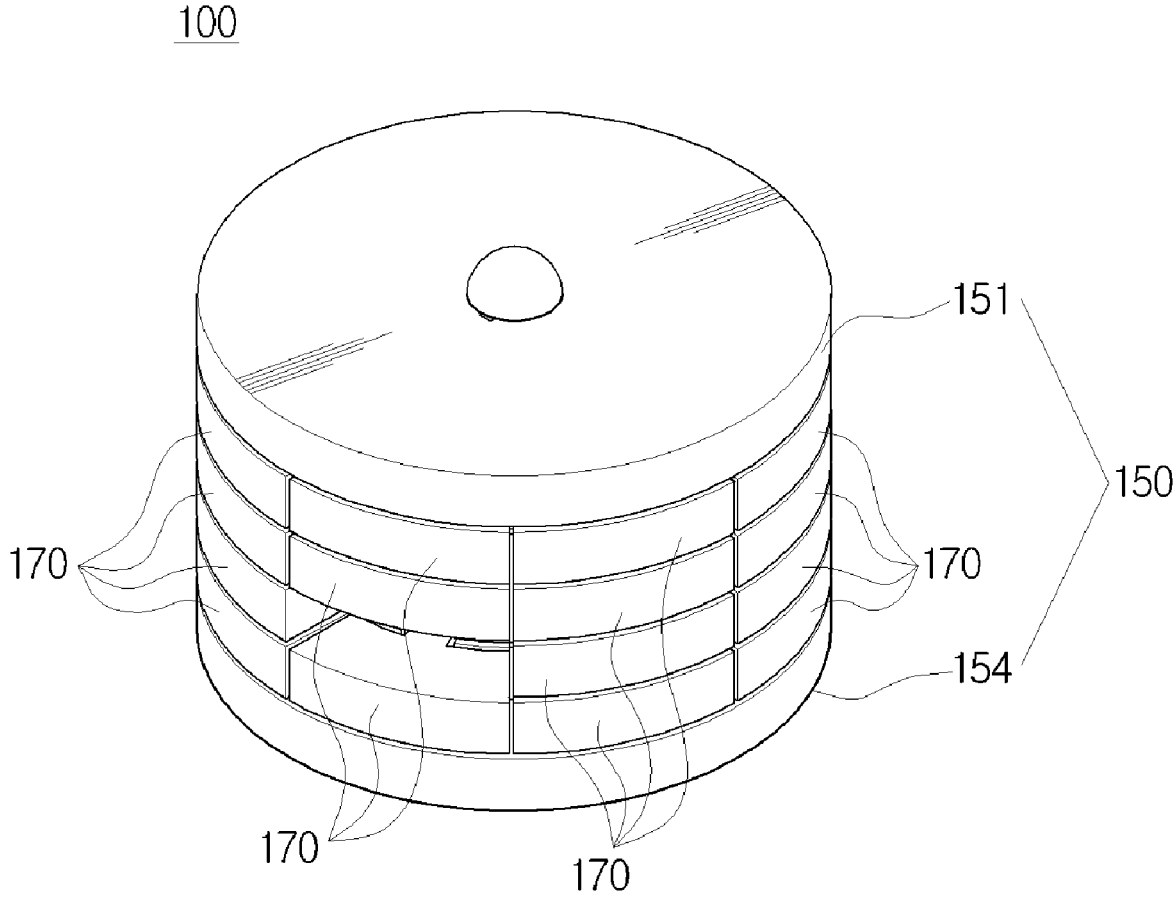
FIG. 1 is a perspective view illustrating the puzzle assembly according to the first exemplary embodiment of the present invention.

A puzzle assembly (100) according to the first exemplary embodiments of the present disclosure will now be described in greater detail with reference to the accompanying drawings.

The puzzle assembly (100) according to the first exemplary embodiment of the invention comprises a plurality of rotation plate members, that is, a first, a second, a third and a fourth rotation member (110,120,130,140), a rotation shaft (160), a puzzle pieces (170) and support plates (150).

Figure 2:
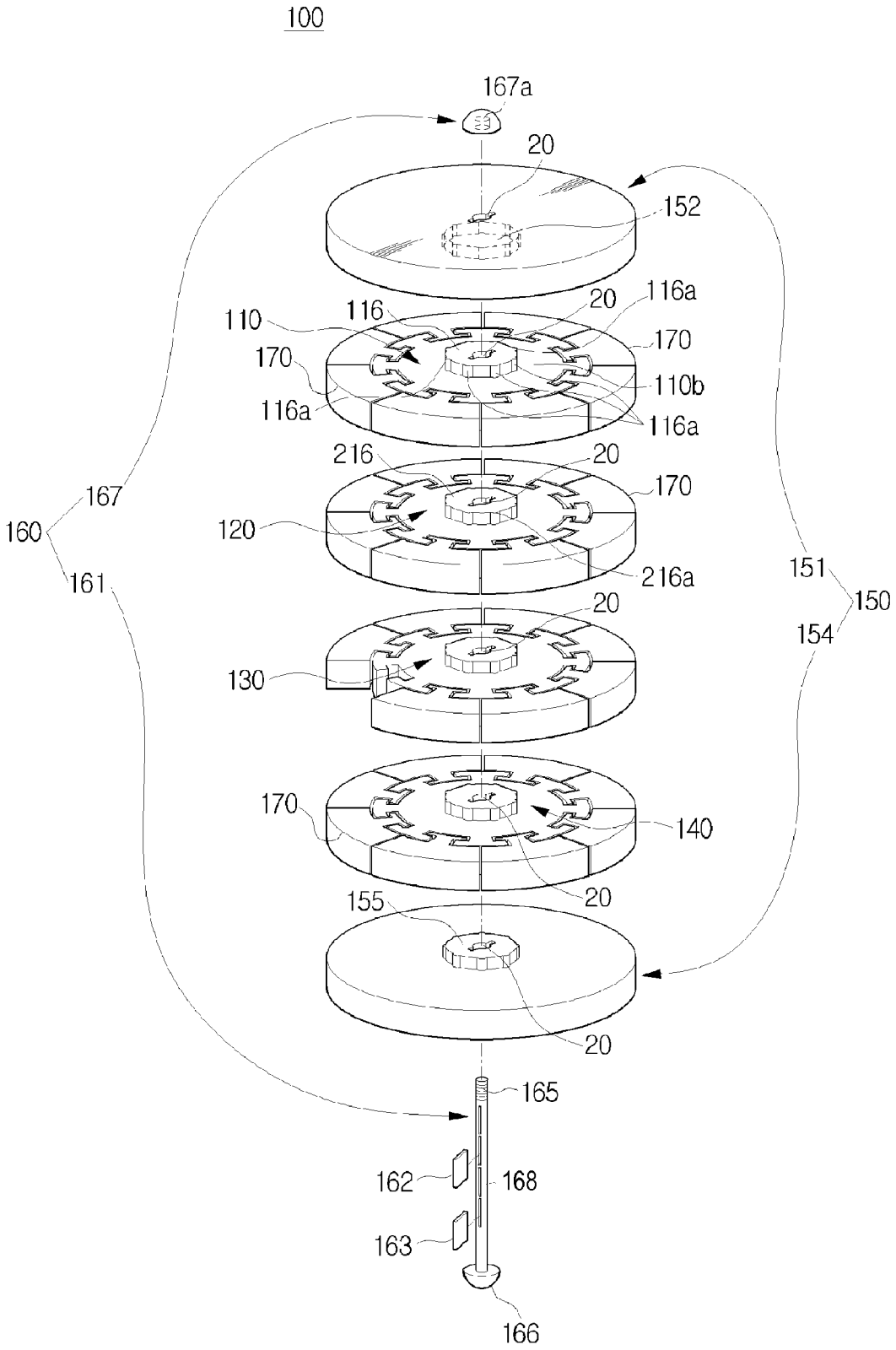
FIG. 2 is a fragmentarily exploded perspective view illustrating the puzzle assembly of FIG. 1.
Figure 3:
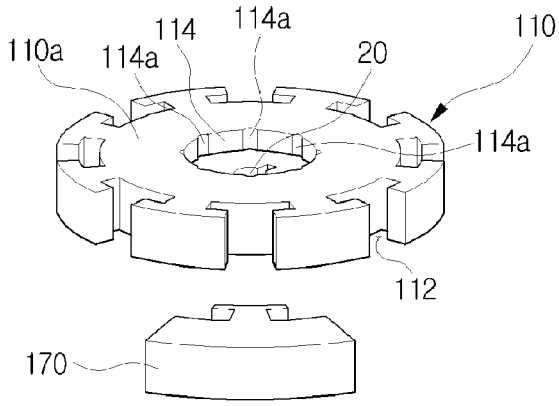
FIG. 3 is a perspective view illustrating the inverted first rotation plate member of the puzzle assembly of FIG. 1.
Figure 4:
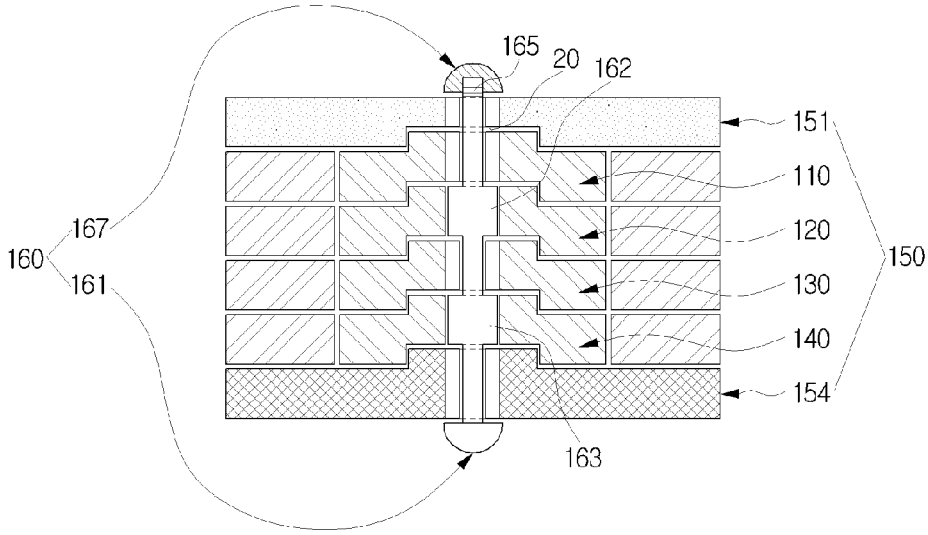
FIG. 4 is a sectional view illustrating the puzzle assembly according to the first exemplary embodiment of the present invention.

FIG. 1 is a perspective view illustrating a puzzle assembly according to the first exemplary embodiment of the invention, FIG. 2 is a enlarged perspective view illustrating one puzzle pieces (170) and a inverted rotation plate member (110) of the puzzle assembly of FIG. 1.

Because the structures of the first to fourth rotation members (110,120,130,140) are same, only the structure of the first rotation member (110) will be described. Referring to FIGS. 1 to 4, several slide grooves (112) are formed in a longitudinal direction on the outer circumference of the first rotation member (110), penetration hole (20) is formed at a center of the first rotation plate member (110) so as to insert the rotation shaft (160) into the penetration hole (20). A first circular hole (114) is formed on one side (110*a*) of the first rotation plate member (110) and a plurality of connecting recesses (114*a*) are formed on the inner circumference of the first circular hole (114) at regular interval. A first circular protrusion (116, refer to FIG. 2) with the same height as the depth of the first circular hole (114) is formed on the other side of the first rotation plate member (110). A plurality of connecting protrusions (116*a*) is formed on the outer circumference of the first circular protrusion (116) so as to insert the connecting protrusions (116*a*) into the connecting recesses (114*a*). According to this embodiment, eight slide grooves (112) are formed on the circumference of the first rotation plate member (110) at same distance, the number of the connecting protrusions (116*a*) and the number of the connecting recesses (114*a*) are also eight respectively. But the number of the slide grooves, the connecting recesses and the connecting protrusions can be various. When a user rotates the first rotation plate member (110) against the second rotation plate member (120) after a second circular protrusion (216) formed on the second rotation plate member (120) is inserted into the first circular hole (114), the connecting recesses (114*a*) formed on the first circular hole (114) are engaged with the connecting protrusions (216*a*) formed on the circular protrusion (216) of the second rotation plate member (120) so as to align the slide grooves (112) of the first rotation plate member (110) and the slide grooves of the second rotation plate member (120) in a beeline. According to this embodiment, four rotation plate member (110,120,130,140) are formed as circular shape, however, can be formed as polygonal shape, for example hexagonal or octagonal shape.

A rotation shaft (160) comprises a rotation shaft body (161), nut (167) and key member (162,163). The rotation shaft body (161) is formed as a cylinder pipe shape, screw threads are formed on one end of the rotation shaft (160) and a shaft head is integrally formed at the other end of the rotation shaft (160) so as not to disengage the first to fourth rotation plate member (110,120,130,140) from the rotation shaft. The nut (167) and the shaft head (160) are the same shape, and the nut (167) has a screw groove (167*a*) engaged with the screw thread (165) of the rotation shaft (160). Referring to FIG. 1 and FIG. 2 according to this embodiment, four opening (168) are formed at regular interval, in longitudinal direction, on the rotation shaft (160) of the puzzle assembly (100). The key members (162.163) are inserted into two of the openings (168). That is, a user can choose two openings into which the key members (162,163) are inserted. The cross section of the key members (162,163) inserted into the openings (168) is the same shape as the cross section of the penetration hole (20) formed at centers of the first to fourth rotation plate members (110,120,130,140) and the support plate (150).

Puzzle pieces (170) are inserted into every slide groove (112) of the first to fourth rotation plate member (110,120,130,140), except only one slide groove the empty slide groove of the third rotation plate member (130), and the puzzle pieces (170) can slide along the move grooves (112). According to this embodiment, each of the puzzle pieces has one color of four different colors. The number of the puzzle pieces is thirty-one and the number of the slide grooves is thirty-two. The thirty-one puzzle pieces are inserted into the thirty-one slide grooves and one empty slide groove remains. As shown in FIG. 1 and FIG. 2, one of eight slide grooves of the third rotation plate member (130), the empty slide groove remains without the puzzle piece (170). However, you can remain any slide groove without the puzzle piece among slide grooves (112) of the first to fourth rotation plate member (110,120,130,140).

The support plate (150) comprises a first support plate (151) and a second support plate (154). The first support plate (151) has a support plate hole (152) which is the same shape as the first circular hole (114) of the first rotation plate member (110) on one side thereof, so that the first circular protrusion (116) of the first rotation plate member (110) can be inserted into the support plate hole (152). The second support plate (154) is in a circular plate shape and has a support plate protrusion (155) inserted into a fourth circular hole of the fourth rotation plate member (140). The support plate protrusion (155) has the same shape as the shape of the first circular protrusion (116) of the first rotation plate member (110).

Hereinafter, assembling procedure of the puzzle assembly according to the first exemplary embodiment of the present invention will now be described with reference to FIG. 1 to FIG. 4.

A user inserts the key members (162,163) into openings he chooses from the four openings (168) of the rotation shaft body (161). According to the first embodiment, the key members (162,164) are inserted into second and fourth openings (168) from the top of the rotation shaft (160) so as to connect the second rotation plate member (120) and the fourth rotation plate member (140) to the rotation shaft body (161) and rotate them (120,140) together. After then, a user inserts the second support plate (154), the first to fourth rotation plate members (110,120,130,140) having slide grooves engaged with the puzzle pieces (170) and the empty slide groove, the first support plate (151) and nut (167) into the rotation shaft body (161) one after the other and finishes assembling the puzzle assembly (100). When a user is putting the puzzle, a user rotates the first, the second, the third, the fourth rotation plate members (110,120,130,140) each other to bring the slide grooves (112) into a line, and then in a method of moving the puzzle piece inserted the slide groove (112) adjacent to the empty slide groove into the empty slide groove, a user makes an array the puzzle pieces (170) having the same color horizontally or longitudinally in a line. The two key members (162,163) engaged with the rotation shaft body (161) are also coupled with the second rotation plate member (120) and the fourth rotation plate member (140), therefore, they (120,140) rotate together. That is, due to the second rotation plate member (120) and the fourth rotation plate member (140) are engaged with together by the key members (162,163) and the rotation shaft body (161), when a user rotates the second rotation plate member (120) after holding the third rotation plate member (140) by the other hand, the fourth rotation plate member (140) also rotates simultaneously together with the second rotation plate member (120). Therefore, it becomes more difficult to make an array the puzzle pieces (170) having the same color in a line longitudinally or horizontally. In this manner, by adjusting the number of the rotation plate members coupled together, a user can improve the degree of difficulty of putting the puzzle. That is, by choosing the number of the openings into which the key members are inserted among the four openings (168) of the rotation shaft body (161), a user can rotate at least two rotation plate members together among the first to fourth rotation plate members (110,120,130,140) and adjust the degree of the difficulty of putting the puzzle.

Although representative embodiment of the present invention has been shown and described in order to exemplify the principle of the present invention, the present invention is not limited to the specific embodiment. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

MODE FOR THE INVENTION

According to the puzzle assembly (100) of the present invention, in order to improve the degree of difficulty of putting the puzzle, a user can make the length of the rotation shaft body (161) be longer, and the number of the openings (168), the key members and the rotation plate members increase. A puzzle assembly according to the exemplary second embodiment of the present invention will be described from now on with reference to FIG. 5 and FIG. 6. The same structure to the first embodiment will be used as the same reference number and will not be described.

Figure 5:
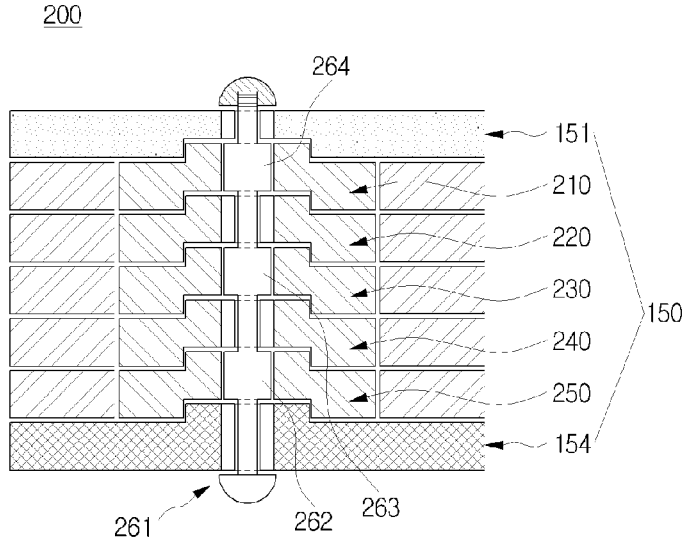
FIG. 5 is a sectional view illustrating the puzzle assembly according to the second exemplary embodiment of the present invention.
Figure 6:
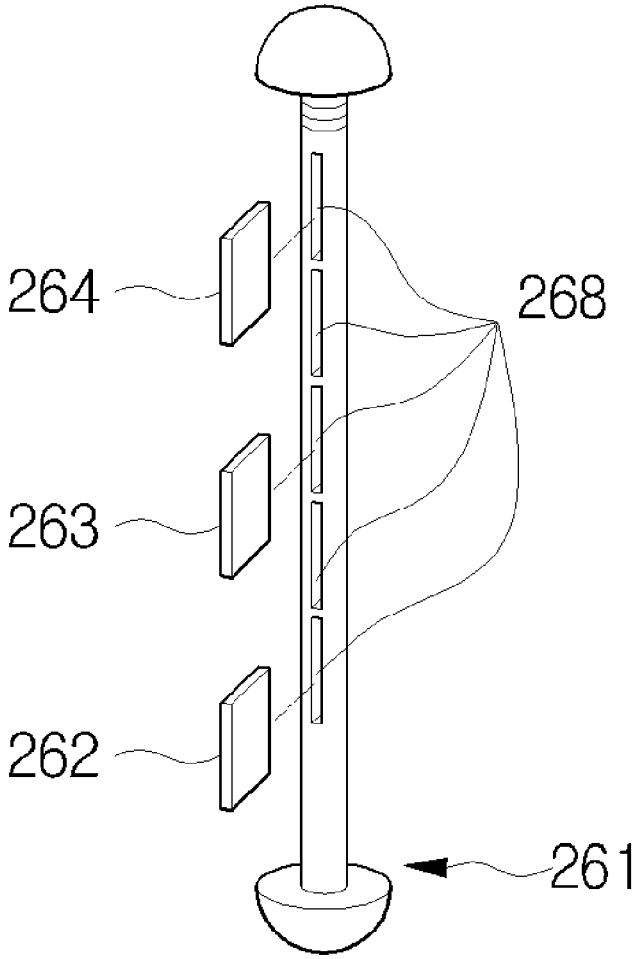
FIG. 6 is a fragmentarily exploded perspective view illustrating the rotation shaft of FIG. 5.

The puzzle assembly according to the second embodiment, like the first exemplary embodiment, can be added more rotation plate members and adjust to improve the degree of difficulty of putting the puzzle. According to the second exemplary embodiment, the puzzle assembly comprises one more rotation plate member compare to the first exemplary embodiment so that the number of the rotation plate members is five (210,220,230,240,250), and a second rotation shaft body (261) which is longer than the rotation shaft body (161) of the first embodiment and having five openings (268, refer to FIG. 6). A user can choose the openings to be engaged with key members (262,263,264) from the five openings (268) at his disposition. According to the second embodiment, the key members (262,263,264) are inserted into the first, the third and the fifth openings from the top among the five openings (210,220,230,240,250) in order to make the three rotation plate members (210,230,250) coupled and rotate together as shown in FIG. 5. Therefore, the degree of difficulty of putting the puzzle assembly according to the second embodiment is higher than that of the putting the puzzle assembly according to the first embodiment.

The puzzle assembly according to the second exemplary embodiment comprises the five rotation plate members, however, it will be understood that one skilled in the art can adjust the degree of difficulty of putting the puzzle, by increasing or decreasing the number of the rotation plate members, the number of the key members, by choosing at his disposition openings into which the key members are inserted.

INDUSTRIAL APPLICABILITY

The present invention relates to a puzzle assembly, more particularly, the present invention relates to a puzzle assembly which a user can adjust the degree of difficulty of putting the puzzle at his disposition.

The invention claimed is:

1. A puzzle assembly comprising a rotation shaft, a plurality of rotation plate members having slide grooves on the outer circumference thereof and inserted onto the rotation shaft, a plurality of puzzle pieces engaged with the slide grooves movably, wherein at least two of the rotation plate members are coupled together and rotate simultaneously, wherein the rotation shaft comprises a rotation shaft body, and a nut connected to the rotation shaft body detachably, so as to increase or decrease the number of the rotation plate members, wherein the rotation shaft further comprises a plurality of key members, and a plurality of openings into which the key members are inserted, the openings formed on the rotation shaft body, wherein each of the rotation plate members comprises a penetration hole into which the rotation shaft body and the key member can be inserted, and wherein the at least two rotation plate members that are coupled together and that rotate simultaneously are coupled together by the key members being inserted into the plurality of openings formed on the rotation shaft body and inserted into penetration holes of the at least two rotation members that are coupled together and that rotate simultaneously.

2. The puzzle assembly as claimed in claim 1, wherein each of the rotation plate members further comprises a circular protrusion, and a circular hole into which the circular protrusion can be inserted, so that the rotation plate members can connect or disconnect each other.

3. The puzzle assembly as claimed in claim 2, further comprising a plurality of connecting recesses formed on the inner circumference of the circular hole, and a plurality of connecting protrusions formed on the outer circumference of the circular protrusion and inserted into the connecting recesses.

4. The puzzle assembly as claimed in claim 1, further comprising first and second support plates, the first support plate mounted on a first side of the rotation plate members and the second support plate mounted on a second side of the rotation plate members.

5. The puzzle assembly as claimed in claim 1, wherein the rotation plate members comprises a first to a fourth rotation plate member, the first and the third rotation plate member are coupled together and rotate simultaneously.

6. The puzzle assembly as claimed in claim 1, wherein the rotation plate members comprises a first to a fifth rotation plate member, the first, the third and the fifth rotation plate member are coupled together and rotate simultaneously.

* * * * *